United States Patent [19]

Randall et al.

[11] 4,302,032

[45] Nov. 24, 1981

[54] CLIP-ON LEDGER BOOK IDENTIFIER

[76] Inventors: Richard A. Randall, 6309 Connaught Ct., Oklahoma City, Okla. 73132; George M. Close, 400 Thornton, Norman, Okla. 73069

[21] Appl. No.: 70,603

[22] Filed: Aug. 29, 1979

[51] Int. Cl.[3] ..... B42D 3/18; G09F 3/06

[52] U.S. Cl. ..... 281/29; 40/23 A; 40/360; 402/3

[58] Field of Search ..... 40/16.2, 16.4, 16.6, 40/10 D, 23 A, 11 R, 259, 260, 454; 283/21, 64; 402/3, 60–68; 281/36, 29

[56] References Cited

U.S. PATENT DOCUMENTS

| | | | |
|---|---|---|---|
| 2,796,688 | 6/1957 | Van Praag | 40/16.6 X |
| 3,196,564 | 7/1965 | Boedeker | 40/16.2 X |
| 3,209,757 | 10/1965 | Littler | 40/10 D |
| 3,248,814 | 5/1966 | Zwolinski | 40/23 A |
| 3,626,619 | 12/1971 | Boedeker | 40/360 |

*Primary Examiner*—Paul A. Bell
*Assistant Examiner*—John S. Brown
*Attorney, Agent, or Firm*—Robert M. Hessin

[57] ABSTRACT

A clip-on identifier is provided for a loose-leaf ledger book of the type having a front binder bar with a front cover pivotally attached thereto. The clip-on identifier is formed from a transparent material and includes a middle portion extending across a flat front side of the front binder bar of the ledger book, and inner and outer edge portions for closely engaging inner and outer edges of the front binder bar. The outer edge portion of the clip-on identifier includes an integral magnifying lens for enlarging the appearance of an identifying label located adjacent the outer edge of the front binder bar. The middle portion and inner edge portions of the clip-on identifier are formed from a relatively flexible sheet so that the outer edge portion, including the integral magnifying lens, may be engaged with the outer edge of the front binder bar and then the middle portion may be placed across the flat front side of the front binder bar so that the inner edge portion may be snapped over the inner edge of the front binder bar.

12 Claims, 4 Drawing Figures

CLIP-ON LEDGER BOOK IDENTIFIER

BACKGROUND OF THE INVENTION

1. Field of the Invention

This invention relates generally to identifier means for ledger books, and more particularly, but not by way of limitation to clip-on ledger book identifiers having a magnifying lens means included therein.

2. Description of the Prior Art

The loose-leaf ledger book, with which the clip-on identifier means of the present invention is used, is of itself a part of the prior art. One example of such a ledger book is marketed under the trademark "Boorum & Pease", and designated Model No. 6215 1/2B, which is a ledger book of the type having front and back binder bars wth front and back covers pivotally attached to the binder bars by hinge means.

Additionally, the prior art includes identifier means which slip over the back cover of a loose leaf book as is shown in U.S. Pat. No. 1,539,449 to Wienke.

Various other devices for attaching labels to books, shelves or other articles are disclosed in: U.S. Pat. Nos. 3,305,957 to Sobesky, 3,133,367 to Rueppel, 2,862,318 to Sobesky, 2,846,795 to Balaban, 2,547,239 to Walker, 2,539,069 to Galeone, 1,409,100 to Hamer, 861,020 to Coulter, 507,393 to Thomson.

Although the cited references show various means for attaching identifying labels to books and other articles, none of the cited references disclose an identifier means suitable for attachment to the binder bar of a loose-leaf ledger book such as that disclosed in the present application.

SUMMARY OF THE INVENTION

A clip-on identifier means is provided for a loose-leaf ledger book of the type having a front binder bar with a front cover pivotally attached to the binder bar. The identifier means includes a middle portion spanning a front side of the front binder bar with inner and outer edge portions engaging inner and outer edges, respectively, of the front binder bar. The outer edge portion of the identifier means includes an integral magnifying lens for magnifying an identifying label oriented for viewing at the outer edge of the front binder bar.

A retaining strip extends from the outer edge portion of the clip-on identifier means, and said retaining strip engages a back side of the front binder bar of the ledger book. The middle portion and inner edge portion comprise a transparent flexible sheet formed to closely engage the front side and inner edge of the front binder bar.

The outer edge portion of the identifier means, which includes the magnifying lens, includes an inner surface constructed for close engagement with the outer edge of the front binder bar. The identifier means may be installed upon the front binder bar of the ledger book by placing the retaining strip in engagement with the back side of the front binder, then inserting the inner edge portion of the identifier means through a space between the inner edge of the front binder bar and a hinge connecting the front binder bar to the front cover and snapping the inner edge portion over the inner edge of the front binder bar to lock the same in place thereon.

Numerous features and advantages of the present invention will be readily apparent to those skilled in the art upon a reading of the description of preferred embodiments which follows when taken in conjunction with the accompanying drawings.

DETAILED DESCRIPTION OF THE PREFERRED EMBODIMENTS

Figure 1:
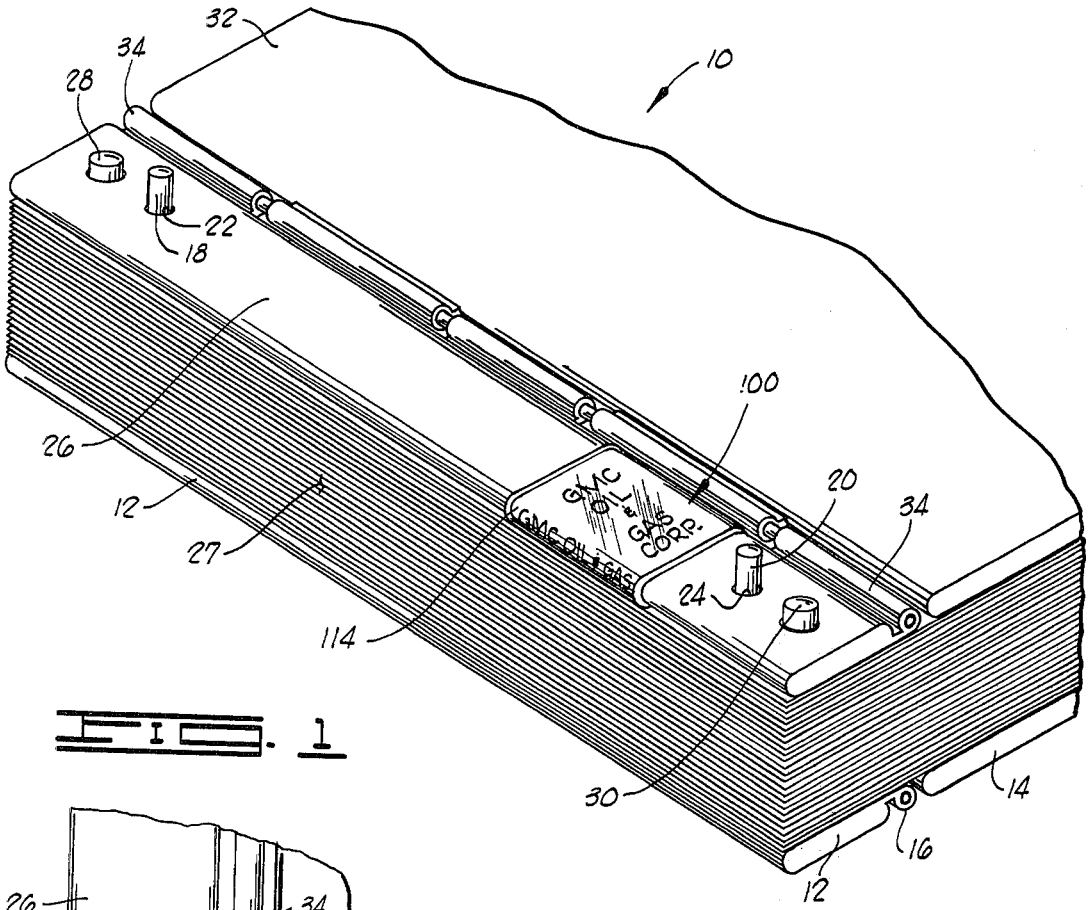
FIG. 1 is an isometric view of a loose-leaf ledger book having the clip-on identifier means of the present invention attached thereto.

Referring now to the drawings, and particularly to FIG. 1, a loose-leaf ledger book, as used with the present invention, is shown and generally designated by the numeral 10.

Ledger book 10 includes a back binder bar 12 having a back cover 14 pivotally attached thereto by a back hinge 16. First and second loose leaf sheet receiving posts 18 and 20 extend upward from back binder bar 12 and are received in holes 22 and 24 of a front binder bar 26. A plurality of loose leaf pages 27 are located on the posts 18 and 20 between front and back binder bars 26 and 12. Front binder bar 26 includes first and second release buttons 28 and 30 for releasing first and second posts 18 and 20, respectively, from engagement with front binder bar 26.

Figure 3:
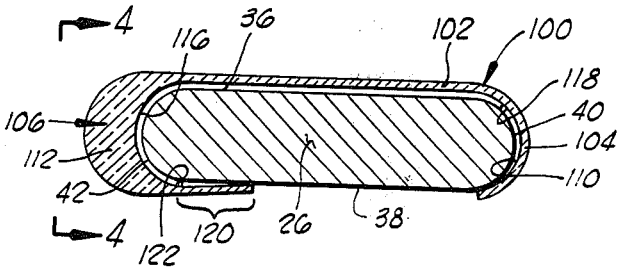
FIG. 3 is a sectional view of the front binder bar of the ledger book with the clip-on identifier means attached thereto, as taken about line 3—3 of FIG. 2.

A front cover 32 is pivotally attached to front binder bar 26 by a front hinge 34. As is best seen in FIG. 3, the front binder bar 26 includes flat top and bottom sides 36 and 38, respectively, and rounded inner and outer edges 40 and 42, respectively, joining the top and bottom sides 36 and 38. Although the cross-sectional view of the front binder bar 26 is shown in FIG. 3 as being of solid construction, the front binder bar 26 is typically of hollow construction and includes mechanisms (not shown) connected between release buttons 28 and 30 and posts 18 and 20.

Figure 2:
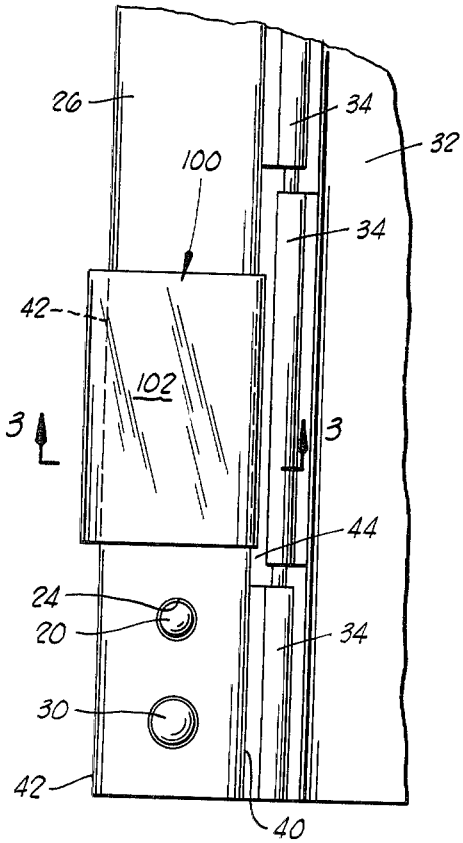
FIG. 2 is a plan view of the lower left-hand front corner of the ledger book of FIG. 1 showing a plan view of the clip-on identifier means.

As is best seen in FIG. 2, the front hinge 34 is spaced from inner edge 40 of top binder bar 26 so as to define a space 44 therebetween.

The ledger book 10 and the various components of the ledger book 10 described up to this point are all old in the art and may be found in a ledger book such as the Boorum & Pease Model No. 6215 1/2B previously mentioned.

The clip-on identifier means of the present invention is shown and generally designated in FIGS. 1–4 by the numeral 100. Clip-on identifier means 100 includes a transparent flat middle portion 102 extending across flat front side 36 of front binder bar 26. Extending from middle portion 102 are first and second transparent edge portions 104 and 106, respectively.

First edge portion 104 includes a round surface 110 for closely engaging rounded inner edge 40 of front binder bar 26.

Second edge portion 106 includes a magnifying lens means 112 for magnifying an identifying label 114, said identifying label 114 being oriented for viewing at said outer edge 42 of front binder bar 26. Magnifying lens means 112 is integrally formed with the remainder of clip-on identifier means 100.

Second edge portion 106 of identifier means 100 includes a rounded surface 116 which fits around and closely engages rounded outer edge 42 of front binder bar 26.

Located on inner surfaces 110 and 116 are first and second raised longitudinally extending ridges 118 and 122, respectively. Ridges 118 and 122 hold middle portion 102 and outer edge portion 106 of identifier means 100 slightly spaced from front binder bar 26 so that identifying label 114 may be received therebetween. Ridges 118 and 122 may be described as a means for receiving identifying label 114 so that the label is viewable through middle portion 102 and outer edge portion 106. As is shown in FIG. 1, identifying label 114 includes a first indicia, "GMC OIL & GAS CORP.", viewable through middle portion 102, and a second indicia "GMC OIL & GAS" viewable through magnifying lens 112 of outer edge portion 106.

The ridges 118 and 122 could be replaced by label receiving grooves (not shown) formed in the inner surfaces of middle portion 102 and outer edge portion 106.

It will be understood that the rounded inner surface 116 of outer edge portion 106 may be described as "closely engaging" outer edge 42, even though there may be a slight clearance therebetween for receiving label 114. By "closely engaging" it is meant that surface 116 fits closely around edge 42 even though surface 116 may not actually touch edge 42.

Extending from second edge portion 106 is a retaining strip 120 which provides a means for engaging flat backside 38 of front binder bar 26.

Figure 4:
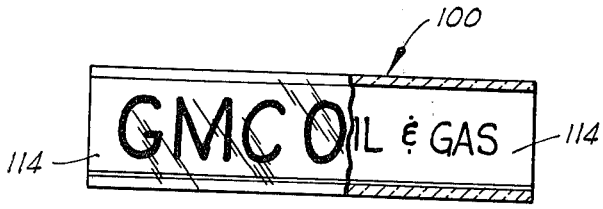
FIG. 4 is a side view taken along line 4—4 of FIG. 3 showing the magnifying lens partly sectioned so as to emphasize the magnifying feature thereof.

Identifying label 114 is shown in FIGS. 1 and 4. The identifying label is not shown in FIGS. 2 and 3, so that the other details of identifier means 100 may be more clearly shown.

The identifier means 100 may generally be described as being a clip-on identifier means which is detachably attached to front binder bar 26. The identifier means 100 is retained in place upon front binder bar 26 by the inner and outer edge portions 104 and 106, in the following manner.

Middle portion 102 and inner edge portion 104 comprise a relatively flexible transparent sheet of material formed in a shape to closely engage top side 36 and inner edge 40 of front binder bar 26.

The outer edge portion 106, which is integrally formed with the remainder of identifier means 100, includes the magnifying lens 112 and is therefore relatively thicker and less flexible than the other portions of identifier means 100.

The retaining strip 120 extending from outer edge portion 106 has a thickness about equal to that of middle portion 102.

The clip-on identifier means 100 is attached to front binder bar 26 in the following manner. The retaining strip 120 is placed in engagement with flat back side 38 of front binder bar 26, and is in effect sandwiched between the uppermost one of loose leaf sheets 27 and the flat back side 38 of front binder bar 26. The curved surface 116 of outer edge portion 106 is placed about the rounded outer edge 42 of front binder bar 26. The middle portion 102 is then laid across flat top side 36 and the inner edge portion 104 is inserted through space 44 between binder bar 26 and front hinge 34 and is snapped over inner edge 40 of binder bar 26 so that surface 110 of inner edge portion 104 engages rounded inner edge 40 of front binder bar 26.

The clip-on identifier means 100 may also be constructed with a retaining strip (not shown) extending from inner edge portion 104.

Due to the presence of integral magnifying lens 112 of outer edge portion 106, the identifying label 114 is magnified so as to enlarge the appearance thereof as illustrated in FIG. 4. In FIG. 4 the right hand portion of magnifying lens 112 has been cut away so as to show a side by side comparison of the unmagnified identifying label 114, as seen on the right-hand side of FIG. 4, as compared to the magnified image thereof as shown in the left-hand side of FIG. 4.

The clip-on identifier means 100 could of course, be attached to back binder bar 12 instead of front binder bar 26.

Thus, the ledger book with clip-on identifier means of the present invention is well adapted to attain the ends and advantages mentioned as well as those inherent therein. While presently preferred embodiments of the invention have been described for the purpose of this disclosure, numerous changes in the construction and arrangement of the parts can be made by those skilled in the art, which changes are encompassed within the spirit of this invention as defined by the appended claims.

What is claimed is:

1. An identification apparatus, in combination with a book of the type having a binder bar with a cover pivotally attached to said binder bar, said binder bar having front and back sides with inner and outer edges connecting said front and back sides, said identification apparatus comprising:

a middle portion for extending transversely across one of said front and back sides of said binder bar; and first and second edge portions, extending at opposite ends from said middle portion, said first and second portions including curved surfaces for closely engaging said inner and outer edges, respectively, of said binder bar thereby to retain said identification apparatus in place thereon, and wherein one of said curved surfaces includes an integral lens means for magnifying an identifying label oriented for viewing at said outer edge of said binder bar.

2. The apparatus of claim 1, wherein one of said first and second edge portions includes a unitarily formed retaining strip means for engaging the other of said front and back sides of said binder bar.

3. The apparatus of claim 2, wherein:

said one of said first and second edge portions including said retaining strip means is further characterized as being said second edge portion.

4. The apparatus of claim 3, wherein said middle portion and second edge portion are transparent.

5. The apparatus of claim 4 wherein:

said middle portion and said second edge portion include means for receiving said identifying label.

6. The apparatus of claim 4, wherein:

said second edge portion includes a means for receiving said identifying label oriented for viewing at said outer edge of said binder bar.

7. The apparatus of claim 6, wherein:

said means for receiving said identifying label includes a longitudinally extending ridge protruding from an inner surface of said second edge portion.

8. A book, comprising:

a back portion, having first and second posts extending therefrom;

a front binder bar including means for detachably receiving said first and second posts, said front binder bar having front and back sides and inner and outer edges connecting said sides, said front binder bar and front cover being connected by a hinge, said hinge and said inner edge of said front binder bar defining a space therebetween;

a front cover pivotally attached to said front binder bar; and an identification means detachably engaged with said front binder bar, said identification means including a lens means located adjacent said outer edge of said front binder bar, for magnifying an identification label, said identification means including a middle portion with inner and outer edge portions extending therefrom to engage said inner and outer edges of said front binder bar, and said inner edge portion of said identification means extending through said space between said inner edge of said front binder bar and said hinge.

9. The book of claim 8, wherein said identification means further comprises a retaining strip extending from one of said inner and outer edge portions thereof, said retaining strip engaging said back side of said front binder bar.

10. The book of claim 9, wherein:

said identification means is so arranged and constructed that said identification means may be installed upon said front binder bar by placing said retaining strip, extending from said one of said inner and outer edge portions, in engagement with said back side of said front binder bar and then snapping the other of said inner and outer edge portions over an edge of said front binder bar.

11. The book of claim 9, wherein:

said one of said inner and outer edge portions is said outer edge portion.

12. The book of claim 11, wherein:

said middle portion and inner edge portion comprise a relatively flexible sheet formed to closely engage said front side and inner edge of said front binder bar; and said outer edge portion of said identification means includes said lens means and has a surface for closely engaging said outer edge of said front binder bar so that said identification means may be installed upon said front binder bar by placing said retaining strip in engagement with said back side of said front binder bar and then inserting said inner edge portion of said identification means through said space between said inner edge and said hinge and snapping said inner edge portion of said identification means over said inner edge of said front binder bar.

* * * * *